US006910522B2

(12) United States Patent
Crafton et al.

(10) Patent No.: US 6,910,522 B2
(45) Date of Patent: Jun. 28, 2005

(54) METHODS AND APPARATUS FOR HEAT TREATMENT AND SAND REMOVAL FOR CASTINGS

(75) Inventors: Scott P. Crafton, Marietta, GA (US); Paul M. Crafton, Kennesaw, GA (US); Volker R. Knobloch, Woodstock, GA (US); James L. Lewis, Jr., Kennesaw, GA (US); Ian French, Kennesaw, GA (US); Franz Ruegg, Kennesaw, GA (US)

(73) Assignee: Consolidated Engineering Company, Inc., Kennesaw, GA (US)

( * ) Notice: Subject to any disclaimer, the term of this patent is extended or adjusted under 35 U.S.C. 154(b) by 111 days.

(21) Appl. No.: 10/636,367

(22) Filed: Aug. 7, 2003

(65) Prior Publication Data

US 2005/0022957 A1 Feb. 3, 2005

Related U.S. Application Data

(63) Continuation-in-part of application No. 10/066,383, filed on Jan. 31, 2002, now Pat. No. 6,672,367, and a continuation-in-part of application No. 09/665,354, filed on Sep. 19, 2000, now abandoned, which is a continuation-in-part of application No. 09/627,109, filed on Jul. 27, 2000, now abandoned.

(60) Provisional application No. 60/401,969, filed on Aug. 8, 2002, provisional application No. 60/266,357, filed on Feb. 2, 2001, provisional application No. 60/202,741, filed on May 10, 2000, provisional application No. 60/150,901, filed on Aug. 26, 1999, and provisional application No. 60/146,390, filed on Jul. 29, 1999.

(51) Int. Cl.[7] ..... B22D 29/00; B22D 27/04

(52) U.S. Cl. ..... 164/404; 164/722; 164/345; 266/252; 432/171

(58) Field of Search ..... 164/404, 322, 164/345, 5, 131, 132, 121; 266/252; 432/171; 148/538

(56) References Cited

U.S. PATENT DOCUMENTS

| | | | | |
|---|---|---|---|---|
| 2,385,962 | A | 10/1945 | Barnett | 34/13 |
| 2,813,318 | A | 11/1957 | Horth | 22/89 |
| 2,988,351 | A | 6/1961 | Barnett et al. | 263/40 |
| 3,534,946 | A | 10/1970 | Westerkamp et al. | 263/28 |

(Continued)

FOREIGN PATENT DOCUMENTS

| | | | |
|---|---|---|---|
| CA | 1197981 | 12/1985 | 38/18 |
| DE | 2307773 | 2/1973 | |
| DE | 2323805 | 5/1973 | |
| DE | 2315958 | 4/1974 | B08B/5/00 |

(Continued)

OTHER PUBLICATIONS

Economical Used Energy Type Continuing Heat Treating Furnace For Aluminum Castings Dogyo—Kanetsu vol. 21 No. 2 pp. 29–36—Mar. 1984.

Brochures describing Beardsley & Pipe PNEU–RECLAIM Sand Reclamation Units Prior to Aug. 13, 1992.

(Continued)

*Primary Examiner*—Kiley S. Stoner
*Assistant Examiner*—I.-H. Lin
(74) *Attorney, Agent, or Firm*—Womble Carlyle Sandridge & Rice, PLLC

(57) ABSTRACT

A system and method for heat treating castings and removing sand cores therefrom. The castings are initially located in indexed positions with their x, y, and z coordinates known. The castings are passed through a heat treatment station typically having a series of nozzles mounted in preset positions corresponding to the known indexed positions of the castings passing through the heat treatment station. The nozzles apply fluid to the castings for heat treating the castings and degrading the sand cores for removal from the castings.

10 Claims, 10 Drawing Sheets

U.S. PATENT DOCUMENTS

| | | | | |
|---|---|---|---|---|
| 3,737,280 | A | 6/1973 | Cromp | 432/14 |
| 3,760,800 | A | 9/1973 | Staffin et al. | 128/24.1 |
| 3,871,438 | A | 3/1975 | Vissers et al. | 164/5 |
| 4,068,389 | A | 1/1978 | Staffin et al. | 34/57 A |
| 4,140,467 | A | 2/1979 | Ellison et al. | 432/72 |
| 4,161,389 | A | 7/1979 | Staffin et al. | 432/58 |
| 4,177,952 | A | 12/1979 | Rikker | 241/40 |
| 4,211,274 | A | 7/1980 | Slowinski et al. | 164/401 |
| 4,242,077 | A | 12/1980 | Hyre | 431/19 |
| 4,294,436 | A | 10/1981 | Takahashi | 266/257 |
| 4,325,424 | A | 4/1982 | Scheffer | 164/5 |
| 4,340,433 | A | 7/1982 | Harding | 148/16 |
| 4,392,814 | A | 7/1983 | Harding | 431/170 |
| 4,411,709 | A | 10/1983 | Nakanishi | 148/3 |
| 4,415,444 | A | 11/1983 | Guptail | 209/3 |
| 4,457,352 | A | 7/1984 | Scheffer | 164/5 |
| 4,457,788 | A | 7/1984 | Staffin et al. | 148/20.3 |
| 4,478,572 | A | 10/1984 | Selli | 432/13 |
| 4,499,940 | A | 2/1985 | Hall | 164/36 |
| 4,512,821 | A | 4/1985 | Staffin et al. | 148/16.5 |
| 4,519,718 | A | 5/1985 | Staffin et al. | 374/45 |
| 4,524,957 | A | 6/1985 | Staffin et al. | 266/252 |
| 4,544,013 | A | 10/1985 | Kearney et al. | 164/5 |
| 4,577,671 | A | 3/1986 | Stephan | 164/401 |
| 4,579,319 | A | 4/1986 | Sasaki | 266/252 |
| 4,582,301 | A | 4/1986 | Wunning | 266/87 |
| 4,604,055 | A | 8/1986 | Mackenzie | 432/58 |
| 4,613,713 | A | 9/1986 | Staffin et al. | 585/241 |
| 4,620,586 | A | 11/1986 | Musschoot | 164/253 |
| 4,623,400 | A | 11/1986 | Japka et al. | 148/6.35 |
| 4,648,836 | A | 3/1987 | Thom | 432/107 |
| 4,671,496 | A | 6/1987 | Girrell et al. | 266/78 |
| 4,681,267 | A | 7/1987 | Leidel et al. | 241/23 |
| 4,700,766 | A | 10/1987 | Godderidge | 164/5 |
| 4,779,163 | A | 10/1988 | Bickford et al. | 361/212 |
| 4,830,605 | A | 5/1989 | Hodate et al. | 431/170 |
| 4,955,425 | A | 9/1990 | McKenna | 164/269 |
| 5,018,707 | A | 5/1991 | Hemsath et al. | 266/254 |
| 5,169,913 | A | 12/1992 | Staffin et al. | 526/65 |
| 5,251,683 | A | 10/1993 | Backer | 164/98 |
| 5,253,698 | A | 10/1993 | Keough et al. | 164/269 |
| 5,294,094 | A | 3/1994 | Crafton et al. | 266/44 |
| 5,350,160 | A | 9/1994 | Crafton et al. | 266/252 |
| 5,354,038 | A | 10/1994 | Crafton | 266/44 |
| 5,378,434 | A | 1/1995 | Staffin et al. | 422/141 |
| 5,423,370 | A | 6/1995 | Bonnemersou et al. | 164/132 |
| 5,439,045 | A | 8/1995 | Crafton | 164/5 |
| 5,531,423 | A | 7/1996 | Crafton et al. | 266/44 |
| 5,547,228 | A | 8/1996 | Abbema et al. | 148/16 |
| 5,551,998 | A | 9/1996 | Crafton et al. | 148/538 |
| 5,565,046 | A | 10/1996 | Crafton et al. | 148/538 |
| 5,738,162 | A | 4/1998 | Crafton | 164/5 |
| 5,829,509 | A | 11/1998 | Crafton | 164/5 |
| 5,850,866 | A | 12/1998 | Crafton | 164/5 |
| 6,112,803 | A | 9/2000 | Kruger | 164/103 |
| 6,672,367 | B2 * | 1/2004 | Crafton et al. | 164/5 |

FOREIGN PATENT DOCUMENTS

| | | | |
|---|---|---|---|
| DE | 2337894 | 11/1974 | B08B/7/04 |
| DE | 2914221 | 4/1979 | |
| DE | 3206048 | 2/1982 | |
| DE | 4012158 | 11/1990 | 164/5 |
| DE | 195 30 975 | 2/1997 | B22C/5/00 |
| EP | 0546210 A1 | 6/1993 | B22D/29/00 |
| FR | 7043571 | 12/1970 | |
| FR | 2448573 | 2/1979 | C21D/9/00 |
| GB | 1392405 | 4/1975 | |
| GB | 1564151 | 4/1980 | |
| GB | 1569152 | 6/1980 | |
| GB | 2187398 | 9/1987 | F27B/15/09 |
| GB | 2230720 | 10/1990 | B22O/29/00 |
| JP | 5653867 | 5/1981 | |
| JP | 5939464 | 8/1982 | |
| JP | 5825417 | 2/1983 | C21D/1/00 |
| JP | 5825860 | 2/1983 | |
| JP | 59219410 | 12/1984 | |
| JP | 6092040 | 5/1985 | 164/132 |
| JP | 2074022 | 9/1985 | |
| JP | 62110248 | 5/1987 | |
| JP | 6316853 | 1/1988 | 164/132 |
| JP | 63108941 | 5/1988 | |
| JP | 1-91957 | 4/1989 | 164/132 |
| JP | 1-122658 | 5/1989 | B22D/29/00 |
| JP | 2104164 | 8/1990 | |
| JP | 3-465 | 1/1991 | B22D/29/00 |
| SU | 1129012 | 7/1982 | |
| SU | 0234810 | 3/1985 | 164/132 |
| WO | WO 97/30805 | 8/1997 | |
| WO | WO 98/14291 | 4/1998 | |
| WO | WO 02/05986 | 1/2002 | B22D/15/00 |
| WO | WO 02/063051 | 8/2002 | C21D/9/00 |
| WO | WO 02/094479 | 11/2002 | B22D/29/00 |

OTHER PUBLICATIONS

Brochure describing Fataluminum Sand Reclamation Units—Prior to Aug. 13, 1992.

Paul M. Crafton—Heat Treating Aging System Also Permits Core Sand Removal—Reprinted from Sep. 1989 Modern Castings magazine.

Sales brochure describing Thermfire Brand Sand Reclamation, Gudgeon Bros., Ltd. believed to be known to others prior to Sep. 1989.

Sales brochure describing Simplicity/Richards Gas–Fired Thermal Reclamation System Simplicity Engineering, Inc.—believed to be known to others prior to Sep. 1989.

Sales brochure describing AirTrac Brand Fluidizing Conveyor, Air Trac Systems Corp., believed to be known to others prior to Sep. 1989.

Sales brochure describing Fluid Bed Calcifer Thermal Sand Reclamation Systems, Dependable Foundry Equipment Co.—Believed to be known to others prior to Sep. 1989.

Foundry Management & Technology—Dec. 1989—vol. 117; No. 12; p. G3—Shakeout/Cleaning/Finishing Brochure.

* cited by examiner

METHODS AND APPARATUS FOR HEAT TREATMENT AND SAND REMOVAL FOR CASTINGS

CROSS-REFERENCE TO RELATED APPLICATION

This application is a continuation-in-part of U.S. patent application Ser. No. 10/066,383, filed Jan. 31, 2002 and now issued as U.S. Pat. No. 6,672,367, which claims the benefit of U.S. Provisional Application Ser. No. 60/266,357, filed Feb. 2, 2001, and which is a continuation-in-part of U.S. patent application Ser. No. 09/665,354, filed Sep. 19, 2000 now abandoned, which is a continuation-in-part of U.S. patent application Ser. No. 09/627,109, filed Jul. 27, 2000 (now abandoned), which claims the benefit of U.S. Provisional Application Ser. No. 60/146,390, filed Jul. 29, 1999, U.S. Provisional Application Ser. No. 60/150,901, filed Aug. 26, 1999, and U.S. Provisional Application Ser. No. 60/202,741, filed May 10, 2000. This application further claims priority to U.S. Provisional Application Ser. No. 60/401,969, filed Aug. 8, 2002.

TECHNICAL FIELD

This invention generally relates to metallurgical casting processes, and more specifically to a method and apparatus for removal of a sand core from a casting and the heat treatment of the casting.

BACKGROUND OF THE INVENTION

A traditional casting process for forming metal castings employs one of various types of molds for example, a green sand mold, a precision sand mold, or a steel die, having the exterior features of a desired casting, such as a cylinder head or engine block, formed on its interior surfaces. A sand core comprised of sand and a suitable binder material and defining the interior features of the casting is placed within the mold or die. Sand cores generally are used to produce contours and interior features within the metal castings, and the removal and reclaiming of the sand materials of the cores from the castings after the casting process is completed is a necessity. Depending upon the application, the binder for the sand core and/or sand mold, if used, may comprise a phenolic resin binder, a phenolic urethane "cold box" binder, or other suitable organic binder material. The mold or die is then filled with a molten metallic alloy. When the alloy has solidified, the casting generally is removed from the mold or die and may be then moved to a treatment furnace(s) for heat-treating, reclamation of the sand from the sand cores, and, at times, aging. Heat treating and aging are processes that condition metallic alloys so that they will be provided with different physical properties suited for different applications.

In accordance with some of the prior art, once the casting is formed, several distinctly different steps generally must be carried out in order to heat treat the metal casting and reclaim sufficiently pure sand from the sand core. A first step separates portions of sand core from the casting. The sand core is typically separated from the casting by one or a combination of means. For example, sand may be chiseled away from the casting or the casting may be physically shaken or vibrated to break-up the sand core and remove the sand. Once the sand is removed from the casting, heat treating and aging of the casting generally are carried out in subsequent steps. The casting is typically heat treated if it is desirable to, among other treatments, strengthen or harden the casting or to relieve internal stresses in the casting. An additional step consists of purifying the sand that was separated from the casting, including burning the binder that coats the sand, abrading the sand, and passing portions of the sand through screens. Therefore, portions of sand may be re-subjected to reclaiming processes until sufficiently pure sand is reclaimed.

There is, therefore, a desire in the industry to enhance the process of heat treating castings and reclaiming sand core materials therefrom such that a continuing need exists for a more efficient method, and associated apparatus, that allow for more efficient heat treatment, sand core removal, and reclamation of sufficiently pure sand from the sand core.

SUMMARY OF THE INVENTION

Briefly described, the present invention comprises a system and method for heat treating castings, such as for use in a metallurgical plant, and for removing the sand cores used during the casting processes. The present invention encompasses multiple embodiments for efficiently removing and reclaiming the sand of sand cores using fluid streams comprising one or more fluids that degrade the cores. In addition to sand and other suitable filler materials, the cores comprise binder materials that can be soluble in one or more fluids contained in the fluid streams used in the process and directed at or into the castings. When the cores are exposed to the fluid, the binder tends to dissolve and the core degrades.

In one embodiment of the present invention for sand core removal and heat treatment of castings, a molten material, such as aluminum or other metal, is poured into molds or dies. The temperature of the molds or dies can be adjusted, either by beating or cooling, prior to the pouring of the molten material therein in order to make the casting process more efficient. The molds or dies may be preheated to maintain the temperature of the metal close to a heat treatment temperature as the castings are formed in the molds. The castings are then removed from their molds and are each placed in a pre-defined position on a saddle that has known x, y and z coordinates. Each saddle generally is configured to receive one or more castings in a fixed orientation or position with the x, y, and z coordinates of each casting located in a known, indexed position or orientation so that the core apertures of the castings formed by the sand cores are oriented or aligned in known, indexed positions. The saddles further can include locating devices to guide and help maintain the castings in their desired, known indexed position.

Each saddle, with at least one casting positioned therein, is moved through a heat treatment furnace or chamber of a heat treatment station for heat treatment and core removal, and also potentially the reclamation of the sand cores. While passing through the heat treatment station for heat treatment, a series of nozzles with x, y and z coordinates that are fixed or aligned with the position of castings direct streams of one or more fluids, such as steam, water, air, oils, organic solvents and combinations thereof, onto and into the castings. The fluid flows tend to degrade, dislodge and aid in removal of the sand of the sand cores from the internal cavities of the castings as the sand cores are broken down in the heat treatment station, in part by dissolving the binder which can be soluble in one or more components of the fluid stream. Typically, the nozzles are arranged in a series of nozzle stations positioned sequentially through the heat treatment chamber, with the nozzles of each nozzle station oriented in a pre-defined arrangement corresponding to the known positions of the core apertures of the castings, and each nozzle assembly can be controlled remotely through a control system or station.

In another embodiment of the invention, the castings can be left in their molds or dies for "in-die" or "in-mold" heat treatment of the castings. The molds or dies typically are pre-heated before the molten metal of the castings is poured into them to maintain the metal close to a heat treatment temperature for the castings, so as to at least partially heat treat the castings inside the dies while and after the castings solidify. Thereafter, the molds or dies, with their castings therein, typically are located or placed in indexed orientations or positions with their x, y and z coordinates known for pre-heating and/or heat treating of the castings therein and removal of the sand cores.

For heat treatment and the removal and reclamation of the sand cores of the castings, the castings and sometimes the molds or dies generally are passed through a heat treatment furnace of a heat treatment station. The heat treatment station further includes a plurality of nozzle stations each having a series of nozzles oriented or positioned in a pre-defined manner corresponding to the known positions of the molds or dies and castings for applying high pressure fluids thereto. The nozzle stations also can include robotically operated nozzles that move along a pre-defined path around the molds or dies, into various application positions corresponding to the positions or orientations of access openings or apertures in the molds or dies for access to the castings for dislodging the sand cores from the castings. The heat treatment station also can include alternative energy sources, such as inductive or radiant energy sources, or a heated oxygen chamber or a heated fluidized bed, for supplying energy to the dies or mold packs to raise their temperature for heat treating the castings therewithin. Thereafter, the castings are removed from their molds or dies and are passed through subsequent core removal stations or processes to further remove and potentially reclaim the sand cores from the castings.

In a further embodiment, the molds or dies are pre-heated to a pre-defined temperature. Thereafter, as molten metal is poured into the dies, the dies continue to be heated to heat treat castings as they are solidified without removing the castings from the dies. The dies can then be transferred to a quenching station for quenching of the castings and removal of the sand cores therefrom. In this embodiment, the dies generally are maintained in a known, fixed position or orientation at or adjacent the pouring station. The dies are heated by the application of heated fluids from a series of nozzles positioned about the dies, typically in alignment with die access openings thereof. The nozzles further are subsequently moved about the dies between a series of nozzle positions set according to the position or orientation of the dies, for heating the dies to heat treat the castings within the dies. Alternately, the mold or die may be placed, at least partially, in a temperature-controlled fluid bed for heating or otherwise controlling the mold or die temperature for heat treating the castings and possibly accomplishing other purposes.

In yet another embodiment, the casting is pre-heated, either within the mold or with the mold removed, at a pre-heating station in order to adjust the temperature of the casting to approach or reach the appropriate heat treatment temperature range prior to actual heat treatment. One or more fluid streams can be directed at or into the casting during pre-heating or at the pre-heating station in order to heat the casting and/or degrade the core contained therein. The casting may be placed in an indexed position with the fluid stream(s) being supplied from one or more nozzles adjusted to direct the fluid streams at or into the casting. The casting is then transferred to a heat treatment station for heat treating and onto further processing.

Various objects, features, and advantages of the present invention will become apparent upon reading and understanding this specification, taken in conjunction with the accompanying drawings.

DETAILED DESCRIPTION OF THE INVENTION

Figure 1:
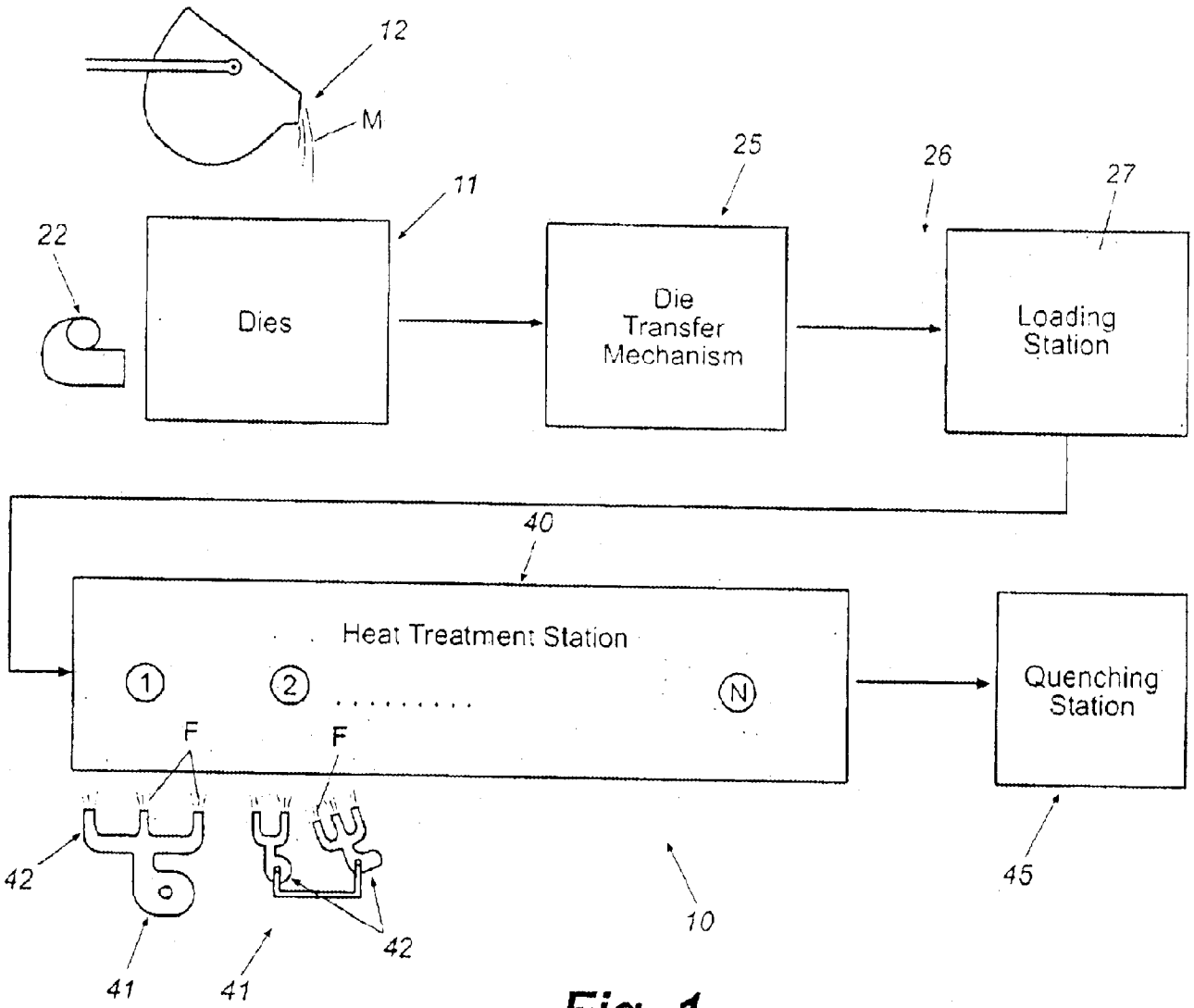
FIG. 1 is a schematic illustration of a first embodiment of the present invention.

Referring now in greater detail to the drawings in which like numerals refer to like parts throughout the several views, FIG. 1 generally illustrates a metallurgical casting process 10. Casting processes are well known to those skilled in the art, and a traditional casting process will be described only briefly for reference purposes. It further will be understood by those skilled in the art that the present invention can be used with any type of casting process, including the formation of castings formed from aluminum, iron and various other types of metals and/or metal alloys.

Figure 2:
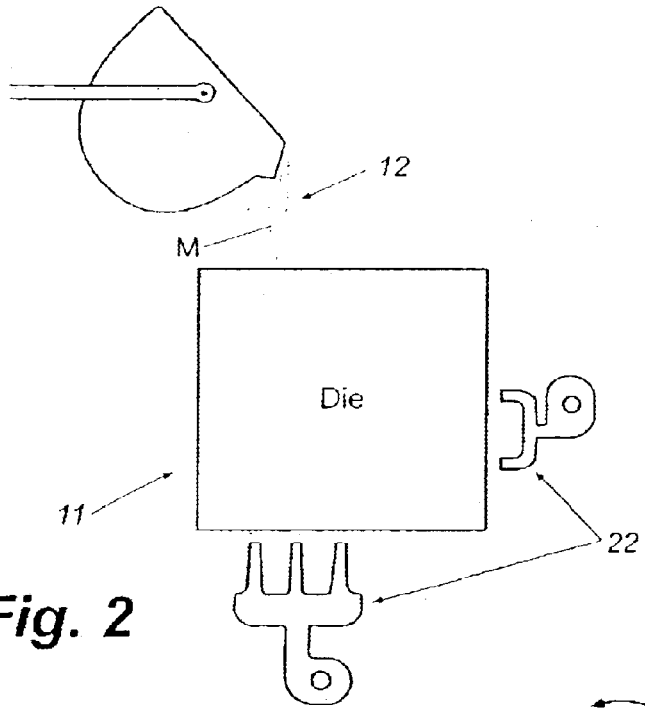
FIG. 2 is a side elevational view illustrating introduction of molten metal into a mold.

As illustrated in FIGS. 1 and 2, according to the present invention, a molten metal or metallic alloy M is poured into a mold or die 11 at a pouring or casting station 12 for forming a casting 13 (FIG. 3) such a cylinder head or an automobile engine block. Typically, casting cores are received or placed within the molds or dies so as to create hollow cavities and/or casting details or core prints within the castings being formed therewithin. Each of the molds or dies 11 typically can be a permanent mold/die and can be formed from a metal such as cast iron, steel or other materials and having a clam-shell style design for ease of opening and removal of the castings therefrom. The molds also can include "precision sand mold" type molds generally formed from a granular material, such as silica, zircon or other sands, mixed with a binder. The binder is formed of a material that is soluble in one or more fluids, such as water, steam, organic solvents and the like. The binder may be formed of casting salts, containing a significant amount of soda ash, which are soluble in water and steam, phenolic resins, phenolic urethane "cold box" binder materials, or other suitable organic binder material, which are soluble in certain organic solvents and/or are thermally degradable. The molds and dies also may be semi-permanent sand molds having an outer mold wall formed from a sand and binder, a metal such as steel or a combination or both types of materials, or can include investment type castings/dies.

The term "molds" will hereafter be used to generally refer to both permanent metal molds and sand type molds, except where a particular type of die or mold is specifically indicated. It further will be understood that the various embodiments of the present invention disclosed herein can be used for processing, castings in permanent or metal dies, precision sand type molds, semi-permanent molds, and/or investment casting molds, depending on the application.

Figure 3:
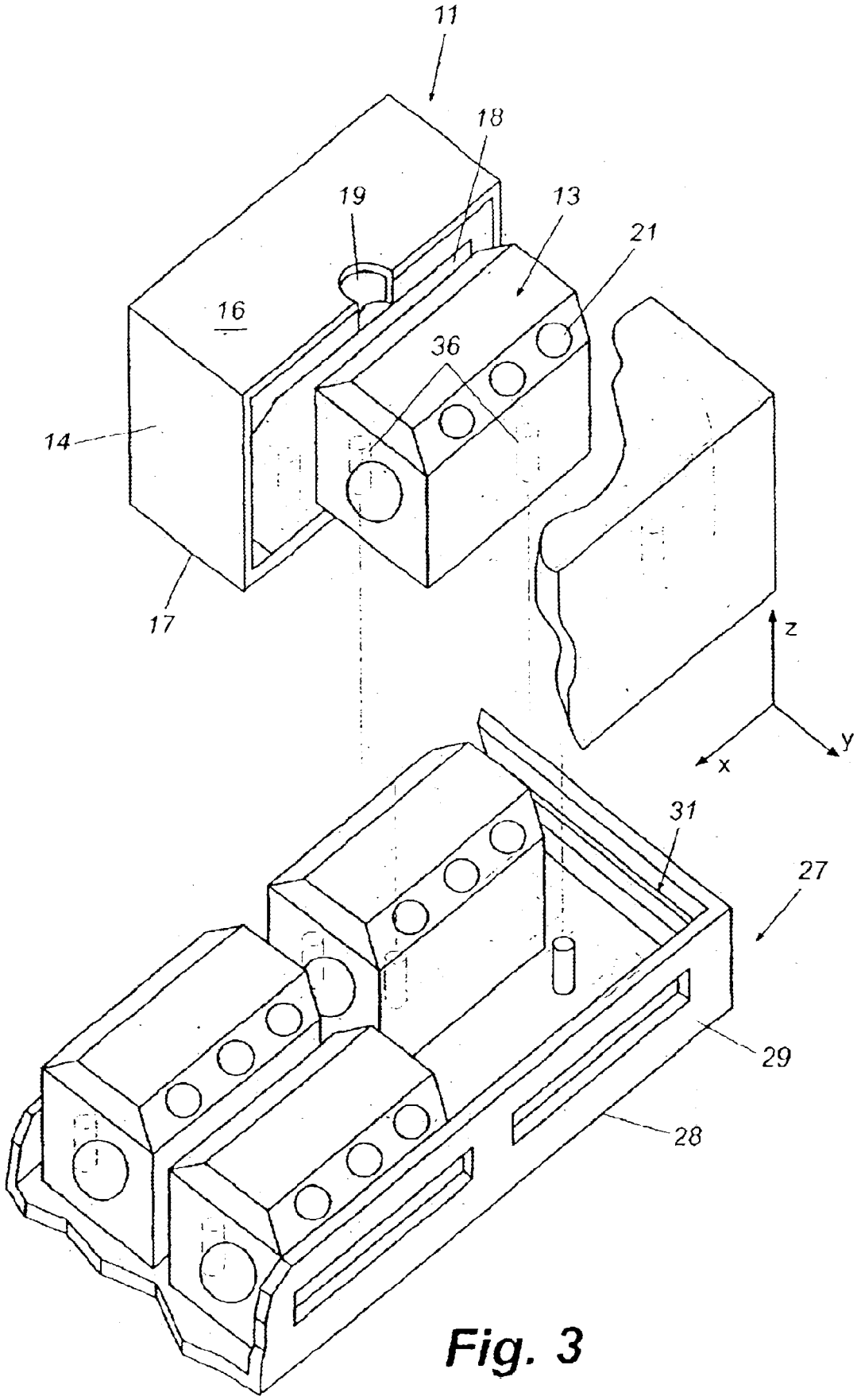
FIG. 3 is a perspective view illustrating the positioning of castings within a saddle.

As FIG. 3 illustrates, each mold 11 generally includes a series of sidewalls 14, a top or upper wall 16, and lower wall or bottom 17, which define an internal cavity 18 within which the molten metal M is received. The internal cavity 18 generally is formed with a relief pattern for forming the internal features of the castings 13 to be formed within the molds so as to define the shape or configuration of the finished castings. A pour opening 19 generally is formed in the upper wall or top 16 of each mold and communicates with internal cavity 18 to enable the molten metal M to be poured or otherwise introduced into the mold as indicated in FIGS. 1 and 2. The resultant casting has the features of the internal cavity of the mold, with additional core apertures or access openings 21 also being formed therein where the sand cores are positioned within the molds.

A heating source or element, such as a heated air blower or other suitable gas-fired or electric heater mechanism, or fluidized bed, 22 also generally is provided adjacent the pouring station 12 for preheating the molds 11. Typically, the molds are preheated to a desired temperature depending upon the metal or alloy used to form the casting. For example, for aluminum, the molds would be preheated to a range of approximately 400–600° C. Other varying preheating temperatures generally will be required for preheating various different metallic alloys or metals for forming the castings are well known to those skilled in the art and can include a wide range of temperatures above and below 400–600° C. Additionally, some mold types may require lower process temperatures to prevent mold deterioration during pouring and solidification. In such cases, such where the metal processing temperatures are required to be higher, a suitable metal temperature control method, such as radiant or induction heating, can be employed to accomplish the process specified herein.

Alternatively, the molds can be provided with internal heating sources or elements for heating the molds. For example, for embodiments in which the castings are being formed in permanent type metal dies, the dies can include cavities or passages formed adjacent the casting and in which a heated fluid medium such as a thermal oil is received and/or circulated through the dies for heating the dies. Thereafter, thermal oils or other suitable media can be introduced and/or circulated through the dies, with the oil being of a lower temperature, for example 250° C.–300° C., to cool the castings and cause the castings to solidify. A higher temperature thermal oil, for example, heated to approximately 500° C.–550° C., then typically will be introduced and/or circulated through the dies to arrest the cooling and raise the temperature of the castings back to a soak temperature for heat treating the castings in their dies. The pre-heating of the dies and/or introduction of heated media into the dies causes the dies to function as heat treatment units and helps maintain the metal of the castings at or near a heat treatment temperature so as to minimize heat loss as the molten metal is poured and solidifies in the dies and thereafter are transferred to a subsequent processing station for heat treatment.

As indicated in FIG. 1, once the molten metal or metallic alloy has been poured into the mold and has at least partially solidified into a casting, the mold and casting generally are removed from the pouring station 12 by a mold transfer mechanism 25, and are transferred to a loading station 26. The mold transfer mechanism can include a die transfer robot (not shown), winch or other type of conventionally known transfer mechanism for moving the molds from the pouring station to the loading station located in close proximity to the pouring station. In a first embodiment of the invention, after the molten metal M has solidified within the mold to form the casting, the casting 13 (FIG. 3) is removed from its mold 11 prior to or at the loading station 26 (FIG. 1), such as by a robotic arm or similar mechanism, and is placed within a saddle 27 in a predefined, indexed position with its x, y, and z coordinates known. As a result, the core apertures 21 (FIG. 3) of the castings likewise are oriented or aligned in known positions for removal of the sand cores from the castings.

As FIG. 3 illustrates, each saddle generally is a basket or carrier typically formed from a metal material and having a base 28 and a series of side walls 29 so as to define an open casting chamber or receptacle 31 in which one or more castings 13 are received with the core apertures or access openings thereof exposed. The castings are generally fixed in their known indexed or registered orientation or position when placed within the receptacle 31 of their saddle 27. The saddles further can be of a variety of sizes to accommodate multiple castings therein for transport, with each of the castings contained therein being maintained in a predefined, indexed position as indicated in FIG. 3. In addition, as indicated in FIG. 3, the saddles 27 can further include locating devices 32 mounted to the base and/or walls 28 and 29 of each saddle for guiding and maintaining the castings into their desired, indexed positions within the saddles 27.

The locating devices can include guide pins 33, such as shown in FIG. 3, or can include notches or grooves, such as indicated by dashed lines 34 in FIG. 3 or other, similar devices for guiding or directing the castings into a desired indexed position or orientation. Typically, the guide pins 33 will be formed from a metal material such as cast iron or similar material having a high heat resistance, and are mounted to the base or any of the sidewalls of the saddle. Corresponding locator or guide openings 36 (shown in dashed lines) generally are formed in the casting during the casting process, such as by the use of guide pins mounted to the bottom or side walls of the molds, or through the use of degradable sand core-type materials. As the castings are placed within their saddles, the guide pins are received within the corresponding guide openings of the castings so as to locate and maintain the castings in their desired, indexed positions having known, defined x, y and z coordinates, with the positions of the core access openings of the castings likewise oriented or aligned at known positions to enable more efficient and direct application of heat to the sand cores within the castings to enhance the dislodging and removal of the sand material for reclamation.

In addition, in certain applications, the molds may include a steel or iron "chill" or insert having various design features of the casting imparted thereon for improved grain structure of the casting. These chills can be either removed after pouring or can be left with and remain part of the casting upon solidification of the molten metal of the casting. The chills, if left in the casting, also can be used as locating devices to enable the castings to be located within their saddles in their desired alignment or position. The features or detail left by the removal of the chill can also act as a locating point for engagement of a guide pin or other locating device within the saddle so as to hold each casting in its desired, indexed position.

As indicated in FIG. 1, after each casting 13 has been loaded in its saddle with the x, y and z coordinates of its position or orientation known, the castings are then moved in their saddles into and through a heat treatment station 40 for heat treatment, core removal and sand reclamation if desired. The saddles are generally conveyed or moved through the heat treatment station on a conveyor or rails so that the castings are maintained in their known indexed positions as they are moved through the heat treatment station. The heat treatment station 40 generally includes a heat treatment furnace, such as a gas fired furnace, and generally includes a series of treatment zones or chambers for heat treating each casting and removal and reclamation of the sand material of the sand cores. Such heat treatment zones can include various types of heating environments such as conduction, including the use of fluidized beds, and convection, such as using heated air flows. Other heating chambers or application means could include induction and radient heating heating environments. The number of treatment zones and/or environments can be divided into as many or as few number of zones as the individual applications may require to heat treat and remove the sand cores therefrom, and each casting typically is kept inside its mold until a saddle is available to move it through a heat treatment station. It is further possible to additionally age the castings within the heat treatment station 40 if so desired.

Examples of a heat treatment furnace or system in which heat treatment of castings is carried out in conjunction with the removal of the sand cores from the castings, and potentially the reclamation of the sand from the sand cores of the castings as well, are illustrated in U.S. Pat. Nos. 5,294,094; 5,565,046; and 5,738,162, the disclosures of which are incorporated herein by reference. A further example of a heat treatment furnace for the heat treatment of metal castings and in-furnace and sand core removal and sand reclamation that can be utilized with the present invention is illustrated in U.S. Pat. No. 6,217,317, the disclosure of which is likewise incorporated herein by reference. Furthermore, U.S. patent application Ser. Nos. 60/401,969; 10/066,383; and, 09/665,354 are hereby incorporated by reference in their entirety.

As indicated in FIG. 1, the heat treatment station 40 includes a heat and/or fluid source or element 41, here illustrated as including a series of nozzle stations 42 positioned at spaced intervals along the length of the heat treatment station to enhance the heat treatment and sand core removal from the castings. The number of nozzle stations positioned along the heat treatment station can vary as needed, depending upon the core print or design of the casting. Each of the nozzle stations or assemblies 42 includes a series of nozzles 43, mounted and oriented at known or registered positions corresponding to the known, indexed positions of the castings being passed therethrough in their saddles. The number of nozzles in each nozzle station is variable, depending upon the core prints of the castings, such that different types of castings having differing core prints can utilize an optionally different arrangement or number of nozzles per nozzle station. The nozzles typically are controlled through a control system that can be operated remotely so as to engage or disengage various ones of the nozzles at the different nozzle stations as needed, depending upon the design or core prints of the castings passing through the heat treatment station.

Each nozzle 43 generally is mounted in a predetermined position and/or orientation, aligned with one of the core apertures or access openings or core prints or a set of core apertures formed in the castings according to the known, indexed positions or orientations of the castings within the saddles. Each of the nozzles is supplied with a fluid media, typically under high pressure and heated, which includes one or more components in which one or more components of the core are soluble. For example, the fluid media used may include air, water, steam, thermal oils, other organic solvents and mixtures thereof. The fluids are directed at the core openings under high pressure, so as to develop relatively high fluid velocities, typically approximately 1,000 FPM to approximately 15,000 FPM, although greater or lesser velocities and thus pressures also can be used as required for the particular casting application. The pressurized fluid flows, streams or blasts applied to the castings by the nozzles tend to impact or contact the cores within the castings and help heat treat the castings and cause the binder materials of the sand cores to at least partially dissolve, degrade or otherwise break down. When the core binder materials are exposed to fluid in which it is soluble, it begins to dissolve in the fluid. Dissolution of the binder causes the chemical bonds linking the binder molecules to each other and to the filler particles to break down. Breaking of these chemical bonds tends to weaken the core, thereby making it even more susceptible to degradation from the heat and force of impact of the fluid on the core. Thus, when the binder material is soluble in the fluid directed at the core, the core tends to degrade and become dislodged from the casting more rapidly than would otherwise occur if the fluid impacting the core was not a solvent for the particular materials contained within the core. Furthermore, solubility tends to increase with increases in temperature. Thus, if the fluid and/or core is heated the binder material will tend to dissolve even more rapidly in the fluid, thereby causing the degradation of the core to proceed even more rapidly. Accordingly, degradation of the core results from one or more in combination of the heat, force and solvent characteristics of the fluid to which the core is exposed. As the sand cores are broken down or dispersed by the fluid flows, the sand of the sand cores tends to be removed or cleaned from the castings through, the core apertures or access openings with the passage of the fluid flows through the castings for recovery and reclamation of the sand.

The nozzles 43 of each nozzle assembly or station 42, further can be adjusted to different nozzle positions depending upon the characteristics of the castings and the pressure of the fluid flows or blasts can also be adjusted. The adjustment of the nozzles can be accomplished remotely, such as through the use of robotically movable or positionable nozzles. The fluids from the nozzles also can be applied at different temperatures, depending upon which zones within the heat treatment station of the nozzles from which they are dispensed are located, so that the fluid flows will not interfere negatively with the heat treatment process for the castings as they are moved through the heat treatment furnace or station. In addition, the nozzles of each nozzle station can be moved between various nozzle positions including moving between a rest position and an application position, or between several application positions, oriented toward and/or aligned with the core apertures or access openings upon movement of the castings into different zones or stations within the heat treatment station so as to strategically direct high pressure flows of a heated fluid media toward the different core apertures or access openings to cause the sand cores and/or sand molds to be broken up and dislodged from the castings for removal of the sand cores therefrom. Thus, the use of the nozzle stations within the heat treatment furnace or station enhances and enables a more efficient breakdown and removal of the sand cores from each casting during heat treatment of the castings, and can assist in the reclamation of the sand materials from the sand cores for reuse.

As indicated in FIG. 1, after the heat treatment and core removal for each casting has been completed, each casting is removed from the heat treatment station 40 and typically is moved into a quenching station 45. The quenching station 45 typically includes a quench tank filled with a cooling fluid, such as water or other known material in which each casting is immersed for cooling and quenching. The capacity and size of the quench tank generally is a function of the castings being formed and the specific heat of the metal or metal alloy comprising the castings and the temperatures to which each casting has been heated. Alternatively, the quenching station can include one or a series of nozzles for applying cooling fluid to the castings for quenching and/or further binder degradation and core removal.

Figure 5A:
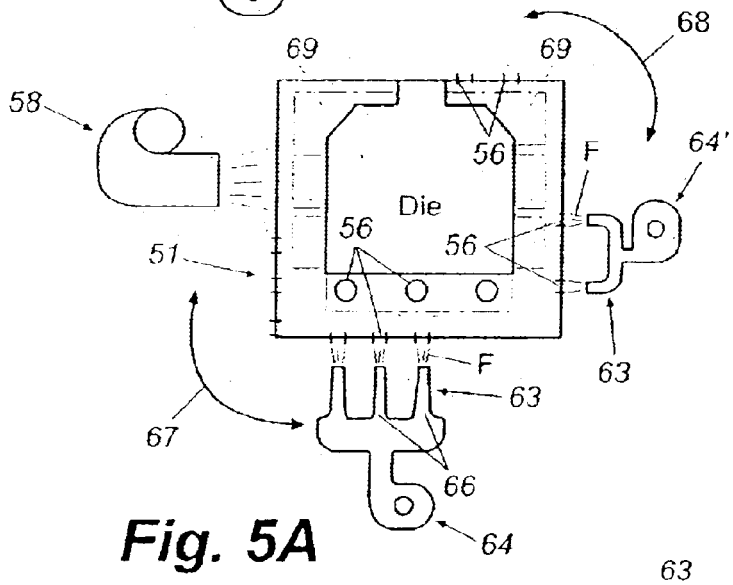
FIGS. 5A–5B are side elevational views illustrating movement of the nozzles to various application positions about a mold or die for in-mold heat treatment and/or core degrading.
Figure 5B:
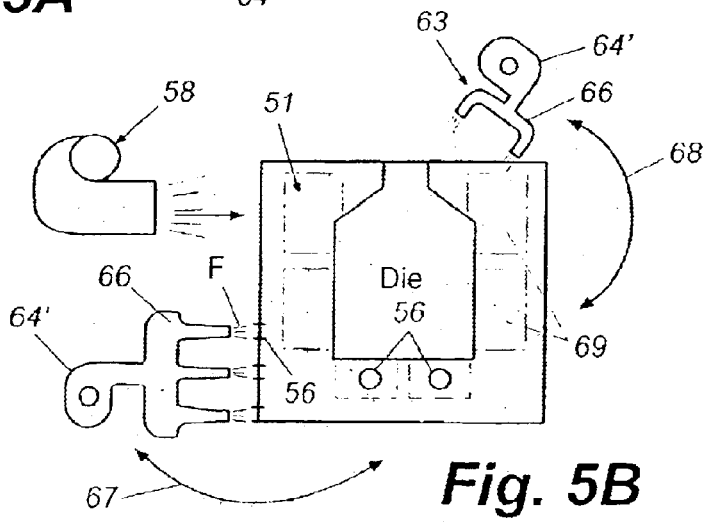
Figure 4:
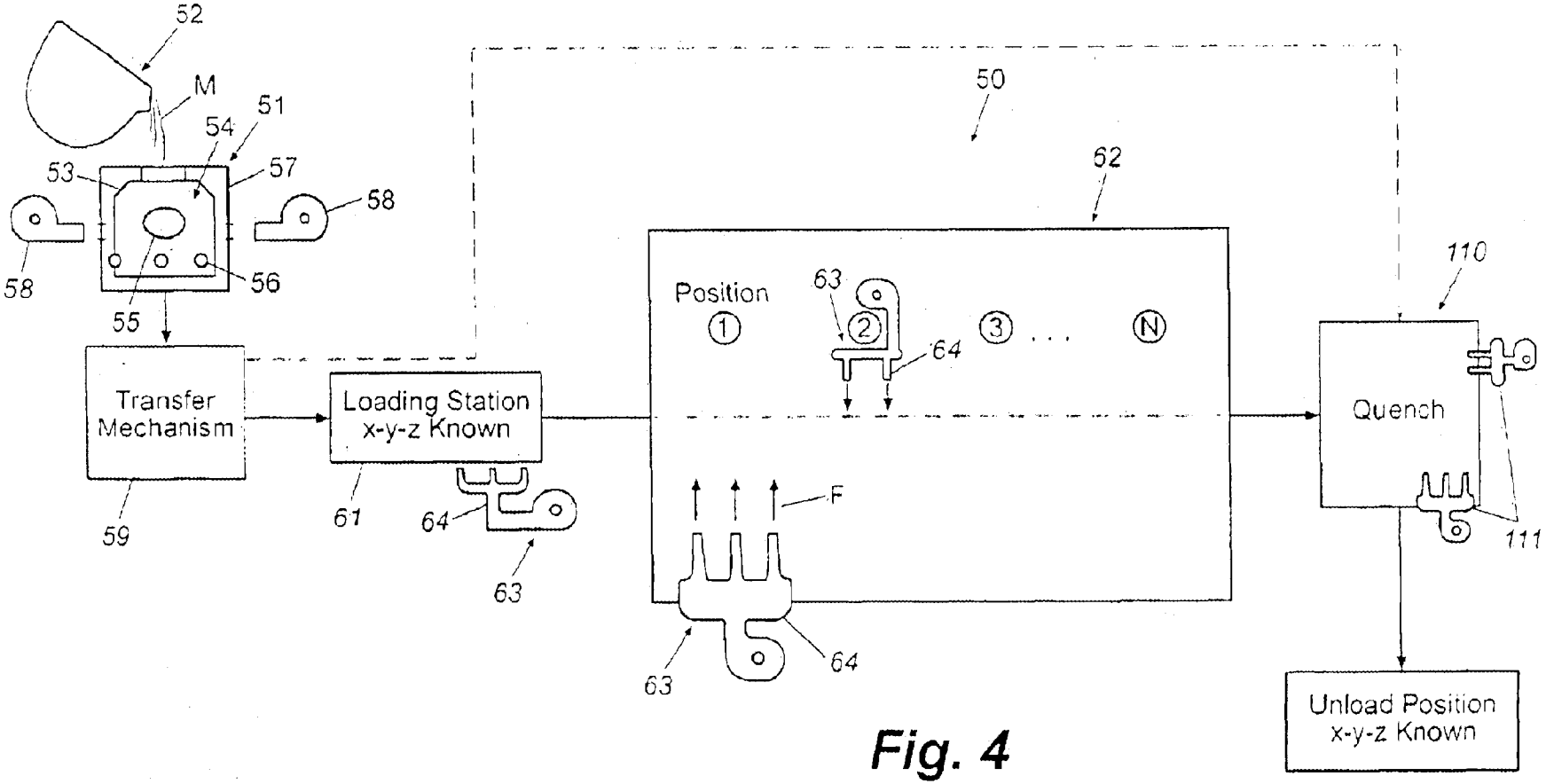
FIG. 4 is a schematic illustration of a further embodiment of the present invention for in-mold heat treating with core removal.

An additional embodiment of the present invention illustrating the in-mold heat treatment of castings is illustrated in FIGS. 4–8B. As illustrated in FIG. 4, in this embodiment of a casting process 50, a molten metal or alloy M is poured into a die or mold 51 at a pouring or casting station 52. As indicated in FIGS. 4–5B, the dies/molds, 51 in this embodiment typically include permanent or semi-permanent dies formed from a metal such as cast iron, steel, or similar material (FIGS. 4–5B) or can be sand or precision sand molds formed from a sand material mixed with an organic binder as is known in the art. Less frequently, molds are made for investment casting in which the mold is comprised of a ceramic coating shaped by a pattern. The molds generally include side sections or shells defining an internal chamber 53 within the dies and in which the molten metal is received for forming castings 54. Each of the molds 51 further generally includes a sand core 55, as illustrated in FIG. 4, generally formed from a sand material mixed with an organic binder for forming bores and or core apertures or access openings in the castings formed within the molds and for creating casting details or core prints. The dies or sand molds 51 in this embodiment, further typically include ports or access openings 56 (FIGS. 4–5B) that are formed at selected, desired positions or locations about the molds and extend through the side walls of 57 of the dies or sand molds 51 so as to provide access to the castings 54 being formed therewithin for direct application of heat to the castings while in-mold and for dislodging and removal of the sand cores therefrom. A heating source or element such as a heated air blower, fluid nozzle, fluid bed, or other suitable gas-fired or electric heater mechanism 58 (FIG. 4) also can be provided adjacent the pouring or casting station 52 for preheating the dies or sand molds as the molten material M is introduced therein.

Alternatively, the permanent metal dies can be formed with cavities adjacent the castings within the dies, in which a heated gas, steam, water, organic solvent, thermal oil or other heated medium can be received and/or circulated through the dies for preheating the dies and enabling the dies to function as a heat treatment unit, heating the castings within the dies. Various areas of the permanent dies further can be heated or cooled variably to enable variations in the desired mechanical properties, of the castings formed therein, such as increased toughness or elongation properties, along desired areas of the castings. Typically, the permanent metal dies are preheated to a desired temperature depending upon the heat treatment temperature required for the metal or alloy being used to form the casting, i.e., 400–600° C. for aluminum. The pre-heating of the permanent metal dies tends to substantially maintain and minimize loss of temperature of the castings being formed within the permanent metal dies at or near the heat treatment temperature for the castings as the permanent metal dies are transferred from the pouring station and to at least partially heat treat the castings as they solidify, and to enhance the heat treatment of the castings by reducing heat treatment times since the castings do not have to be significantly reheated to raise their temperature to levels necessary for heat treatment.

Active temperature control of the mold or die also permits careful control of metal solidification rates within the mold or die. Thus, the process may include prescribed, controlled cooling rates for the molten metal, such that the metal solidifies, as a whole or in specific areas, to produce optimized metallurgical microstructures in the solid metal. For example, aluminum alloys may achieve higher properties if the Secondary Dendrite Arm Spacing (SDAS) of the solidified metal is sufficiently small so as to permit more effective solution of the elements. SDAS is typically determined by the cooling rate of the casting or specific area of the casting; thus controlling cooling rates during solidification with the present invention generally will produce the desired SDAS, and hence improved properties in the casting.

Once each mold 51 has been filled with a molten material M, the mold typically is transferred from the casting or pouring station 52 by a transfer mechanism 59 into a nearby loading station 61. The transfer mechanism 59 generally can include a transfer robot, winch, conveyor, carousel or other type of conventionally known transfer mechanism for moving the molds from the pouring station to the loading station. The transfer mechanism positions each mold in a known, indexed position at the loading station, with the x, y and z coordinates of the dies being located in a known orientation or alignment prior for heat treatment.

In the present embodiment of the invention, the molds thereafter generally are moved into a heat treatment station 62 to at least partially heat treat the castings and break down their sand cores and/or sand molds for removal. As discussed above, the heat treatment station 62 generally includes a heat treatment furnace, typically a gas fired furnace, having a series of treatment zones or chambers for applying heat to the dies and thus to the castings, for at least partial heat treatment of the castings "in-die" or in-mold. The heat treatment zones can include a variety of different heating environments such as conductive or convection heating chambers, for example, fluidized beds or forced air chambers, and the number of treatment zones or chambers can be divided into as many or as few zones as an individual application may require, depending upon the castings being processed. Additionally, following at least partial heat treatment of the castings while in-mold, the castings can be removed from their molds and passed through the heat treatment station for continued heat treatment, sand core removal and possibly for sand reclamation.

An example of a heat treatment furnace for the heat treatment and at least partial breakdown and/or removal of the sand cores from the castings while the castings remain "in-mold", the continued heat treatment, and/or sand core removal, and possibly reclamation of the sand of the cores, from the castings after removal from their dies, is illustrated in U.S. Pat. Nos. 5,294,994; 5,565,046; and 5,738,162, the disclosures of which are hereby incorporated by reference. A further example of a heat treatment furnace for use with the present invention is illustrated and disclosed in U.S. Pat. No. 6,217,317, the disclosure of which is likewise incorporated herein by reference. These heat treatment furnaces further enable the reclamation of sand from the sand cores of the castings and/or sand molds that is dislodged through the die access openings during heat treatment of the castings while they remain in their dies.

The heat treatment station 62 further generally includes a heat source 63. In the embodiment illustrated in FIGS. 4–5B, the heat source 63 can include a series of nozzle stations 64 or assemblies each equipped with a plurality of nozzles 66. The nozzles of each of the nozzle stations 64 generally are oriented at known, preset positions and/or orientations in registration with the known positions of certain ones or sets of access openings 56 of the molds 51. The number of nozzle stations and the number of nozzles at each station can be varied as needed for providing heat and/or fluid flows in varying degrees and/or amounts to the dies for heat treating the castings therewithin to enable control of the heating of the dies and thus the castings, and the adjustment of the heating to different stages of heat treatment of the castings.

Each of the nozzles generally supplies a flow of a heated fluid media that is directed toward the molds and typically toward a specific die access opening or set of die access openings of each mold as indicated in FIGS. 5A and 5B. The fluid medium applied to the molds typically includes heated air, water, steam, thermal oils, organic solvents, or mixtures thereof, or other conventionally known fluid media that are supplied under high pressure and at varying temperatures to heat the molds, with the temperature of the fluid media flows supplied by the nozzles being controlled to conform to different heat treatment stages as the casting is passed through the different nozzle stations of the heat treatment station. The introduction of the heated fluid media into the molds through the access openings further generally tends to cause the core binder to dissolve so as to cause the cores to at least partially degrade, and be dislodged and/or removed from the castings during heat treatment, with the dislodged sand material passing through the access openings with the draining of the fluids therefrom. In addition, the molds also potentially can be at least partially opened as they pass through the nozzle stations for more direct application of the heated fluids media to the castings and core openings thereof for heat treatment and sand core removal.

In addition to having the castings pass through a series of nozzle stations that include nozzles mounted in fixed positions in registration or corresponding to the known positions of the molds, and thus the known positions of the access openings, it is further possible to maintain the molds in a fixed casting position at a single nozzle station or at the pouring station for application of heated fluid media, thereto. In such an embodiment, nozzles 66 (FIGS. 5A and 5B) typically are robotically operated so as to be movable between a series of predetermined fluid application or nozzle positions as illustrated by arrows 67 and 68 in FIGS. 5A and 5B. As the nozzles 66 move about the molds in the direction of arrows 67 and 68, they apply a heated, pressurized fluid media F against the dies, typically directed toward and into the access openings 56, so as to raise and maintain the temperature of the dies at a sufficient temperature for heat treating the metal casting therewithin as the molten metal of the castings is solidified. As the metal solidifies and is brought to the preferred heat treatment temperature, the part may be kept in the mold to complete the heat treatment before removal from the mold and quenching. The various application or nozzle positions of the movable nozzles generally are determined or set according to the known x, y and z coordinates of the molds, and thus their access openings, at the pouring station or upon the positioning or locating of the dies at the loading station by the die transfer mechanism.

As further alternative, the molds, within their castings therein, can be immersed in a fluid bed (as indicated at 73 in FIG. 6) such as disclosed in U.S. Pat. Nos. 5,294,994; 5,565,046; and 5,738,162), the disclosures of which have been incorporated by reference. The molds and castings will be immersed in the fluid bed for heat-up, temperature control and/or mold/core sand removal.

The molds 51 of the present invention typically have the ability to be heated up to approximately 450–650° C. or greater depending upon the solution heat treatment temperatures required for the alloy or metal of the casting that is contained or formed therein, and typically are preheated to a temperature sufficient to enable at least partial heat treatment of the casting immediately after pouring of the molten metal and to enable controlled solidification of the same while the casting yet resides in the mold or die. The heating of the molds further is controlled through control of the temperature of the fluid media applied to the molds so as to heat and maintain the molds at the desired temperatures needed for heat treating the metal of the castings being formed therein to minimize heat loss during transfer to the heat treatment station, and thus minimize the amount of reheating required to raise the castings back to their heat treatment temperatures.

Further, it is also possible to carryout the increasing of the temperature of the dies or sand mold packs for in-die heat treatment of the castings, while reducing the potential heat loss transfer between the molten material and mold surfaces, and the atmosphere, by including an energy or heating source within the mold itself. In such an embodiment, the molds typically are permanent type metal dies formed with cavities or chambers (indicated by dashed lines 69 in FIGS. 5A and 5B) in close proximity to the internal cavity 53 in which the casting is formed. A heated fluid media, such as heated water, steam, thermal oils or other fluid materials capable of readily retaining heat, is then be supplied to the die structure, such as through the ports or access openings 56 (FIGS. 4–5B), received within the internal cavities. This introduction of heated media into the dies tends to increase and help maintain the temperature of the casting at a desired level needed for heat treatment.

Figure 6:
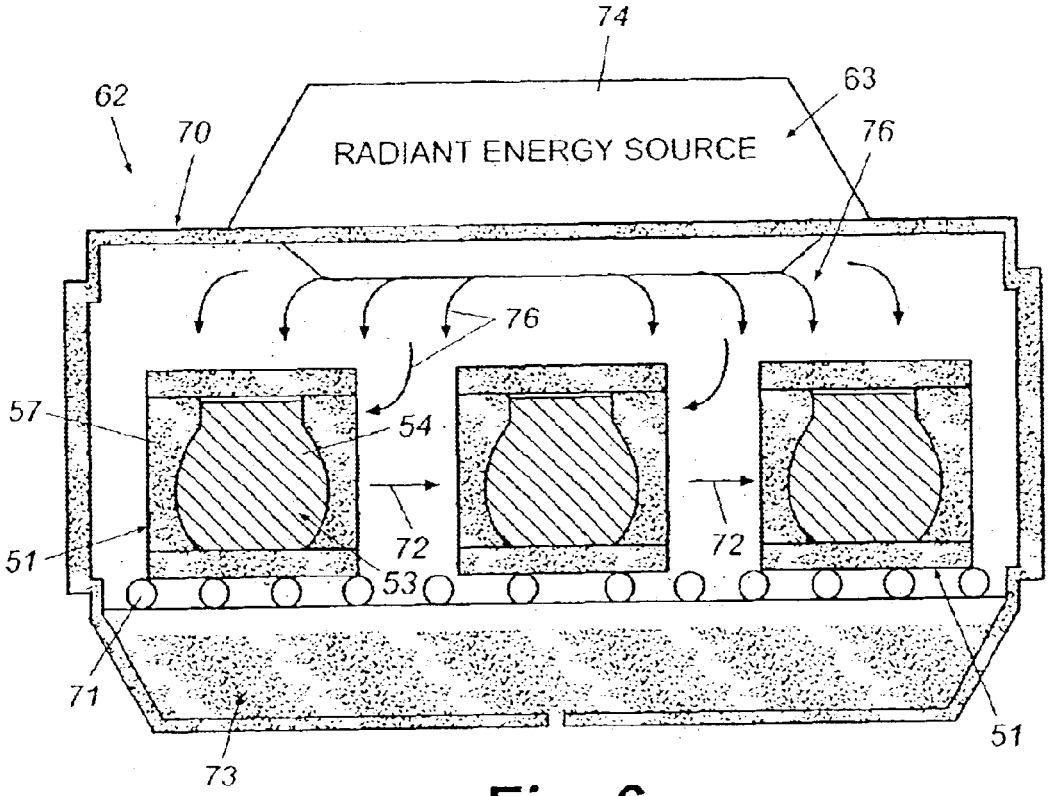
FIG. 6 is a side elevational view schematically illustrating an alternative embodiment of a heating chamber for in-mold heat treatment of castings.
Figure 7:
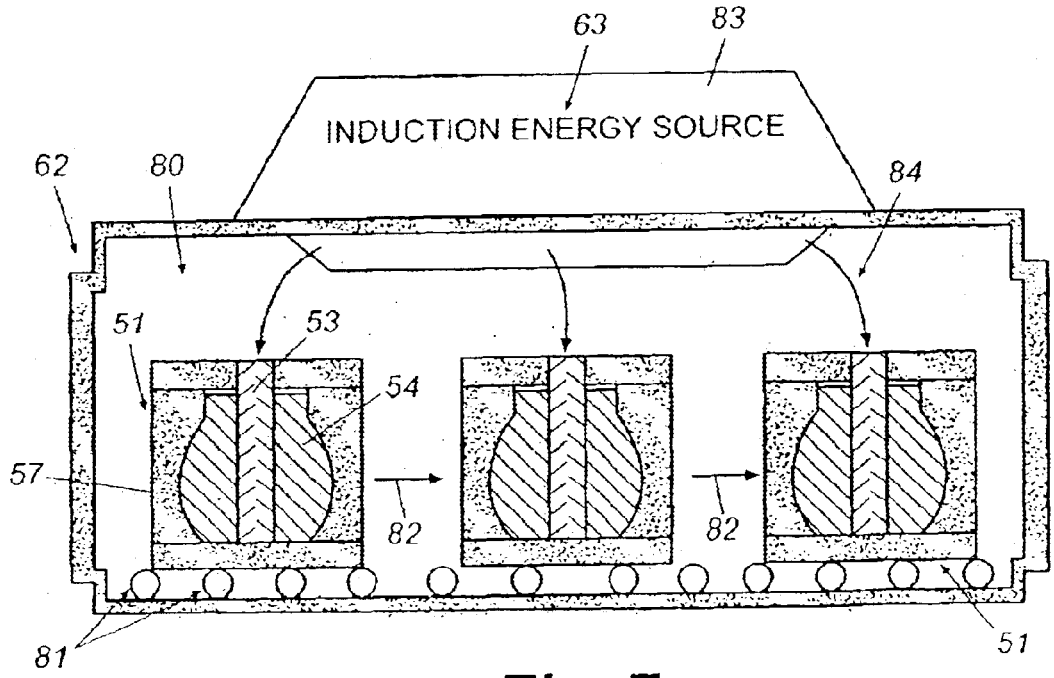
FIG. 7 is a side elevational view schematically illustrating another alternative embodiment of a heating chamber for in-mold heat treatment of castings.

Various alternative embodiments of heat treatment stations or chambers for use in the systems of the present invention are shown in FIGS. 6–8, and can be used separately or in conjunction with each other to supplement or replace the nozzle stations as discussed above with additional heat treatment chambers having various types of alternative, different heat sources 63, which supply or direct energy toward the molds for raising and maintaining the temperature of the molds, at the required temperature for heat treating the castings therein.

In a first example of a heat treatment chamber 70, illustrated in FIG. 6, the molds 51 generally are sand mold packs and are placed on a conveyor or transport mechanism 71 for movement through the heating chamber 70 as indicated by arrows 72. The heating chamber 70 typically is an elongated furnace chamber having an insulated floor, sides, and ceiling and, as illustrated in the embodiment of FIG. 6, a fluidized bed 73, typically formed from foundry sand and sand dislodged from the cores and sand molds for further degrading of the binder and reclaiming of the sand. In this embodiment, the heat source 63 is a radiant energy source 74, typically mounted in the ceiling of the heating chamber 70, although it will be understood by those skilled in the art that the radiant energy source can also be mounted in side walls. In addition, multiple radiant energy sources can be used, mounted in the side walls, overhead and/or below the molds as they are moved through the heating chamber 70 on the conveyor or transport mechanism. An example of a radiant energy source will be a infrared emitter or other known type of radiant energy source.

The radiant energy source generally will direct radiant energy at approximately 400–650° C. toward the dies passing through the heating chamber, typically being directed against the sides and/or top of each mold as illustrated by arrows 74. The molds, and thus the castings therewithin, are subjected to the radiant energy source for a desired length of time, depending upon the metal of the castings being heat treated. The radiant energy generally is absorbed by the molds, causing the temperature of the molds to correspondingly increase so as to heat the molds and thus the castings therewithin from the outside to the inside, of the molds.

FIG. 7 shows a further alternative heating chamber 80 for use in the in-mold heat treatment of the present invention, typically for use with sand mold packs formed from sand and a combustible binder. As shown in FIG. 7, the heating chamber 80 generally is an elongated furnace having an insulated floor, ceiling and sides and includes a conveyor or other transport mechanism 81 for moving the molds, with their castings therewithin, through the heating chamber 80 in the direction of arrows 82. The heat source 63 of the heating chamber 80 generally includes an induction energy source 83 for applying induction energy to the mold packs, and thus to, the castings and sand cores 54 and 55 contained therewithin and can include a fluid bed along its floor for collection and reclamation of sand dislodged from the sand cores and sand molds.

The induction energy source generally can include a conduction coil, microwave energy source or other known induction energy sources or generators, and, as with the radiant energy source of FIG. 6, can be positioned in the ceiling of the heating chamber 80, above the molds, along the sides of the heating chamber, or both. The induction energy source will create a high energy field of waves, indicated by arrows 84, that are directed toward the top and/or sides of the molds 51 and are of a particular frequency or frequencies that will be absorbed by the sand cores 55 so as to cause the temperature of the sand cores and thus the castings to be increased to correspondingly heat treat the metal castings within the mold packs by heating the casting and thus the molds from the inside out.

Figure 8A:
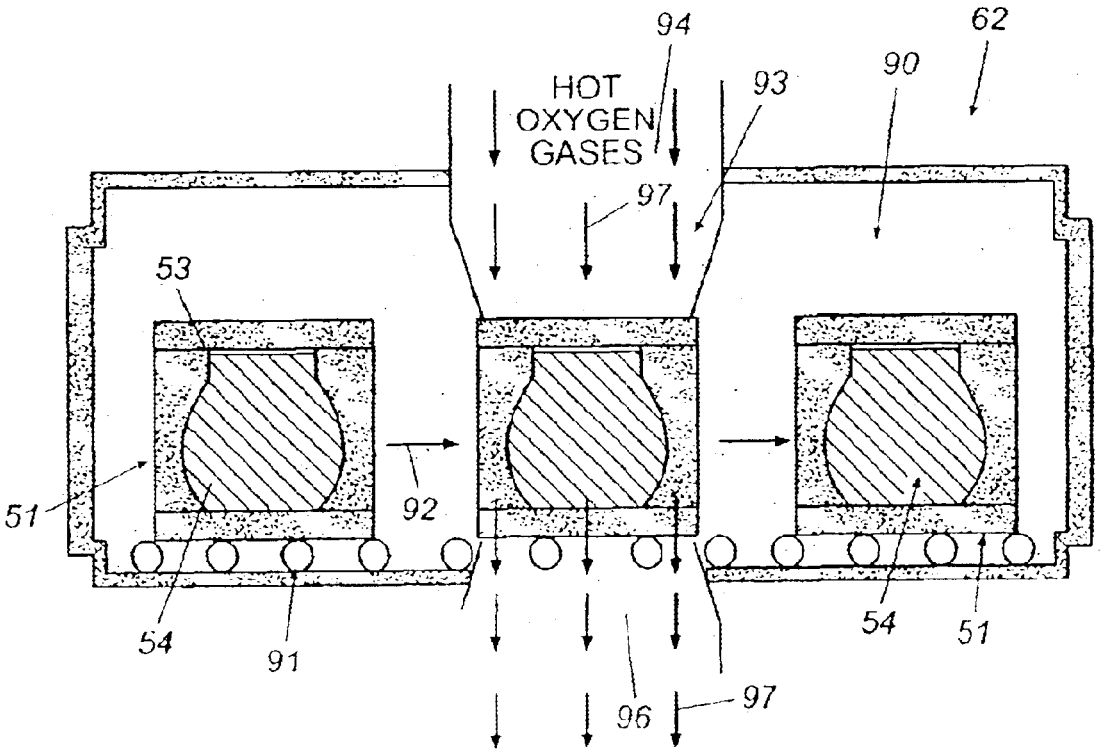
FIGS. 8A–8C are side elevational views schematically illustrating further alternative embodiments of heating chambers for in-mold heat treatment of castings.
Figure 8B:
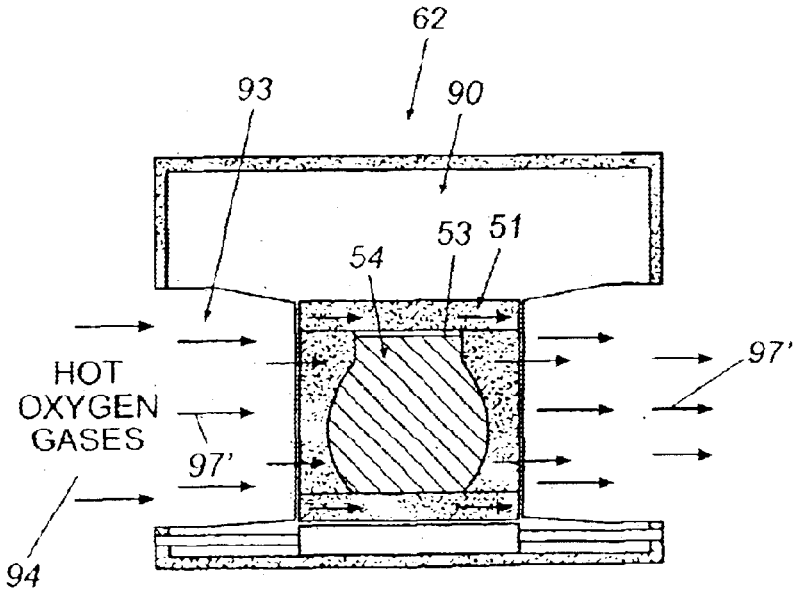

Still a further alternative construction of a heating chamber 90 for use in the present invention for heat treatment of the castings while "in-mold" by adding energy to the molds and thus the castings to increase the temperature thereof is shown in FIGS. 8A and 8B. In this embodiment, the molds typically will comprise sand molds formed from sand and a combustible binder. As shown in FIGS. 8A and 8B, the heating chamber 90 typically is an elongated autoclave or similar heating chamber operating under high pressures or vacuums, and includes a conveyor or transport mechanism 91 for conveying the molds 51 with their castings 54 contained therein in the direction of arrows 92. As the molds and castings are moved through the autoclave heating chamber 90, they generally are passed through a pressurized, low velocity oxygen chamber 93 in which an enriched oxygenated atmosphere is present.

The oxygen chamber generally includes a high pressure, upstream side 94 and a low pressure, downstream side 96 that are positioned opposite each other so that a flow of oxygen is passed therebetween. Typically, the castings and molds will enter the autoclave heating chamber approximately at atmospheric pressure. As the molds pass through the low velocity oxygen chambers of the autoclave heating chamber 90, the pressure in the chamber is increased and the flow of heated oxygen gas is directed at and is forced through the mold packs, as to indicated by arrows 97 (FIG. 8A) and 97 (FIG. 8B). As a result, the oxygen flow is driven into and through the molds and to the inner cores of the castings.

As shown in FIGS. 8A and 8B, the pressurized low velocity oxygen chamber can be oriented in either a vertical orientation (shown in FIG. 8A) or a substantially horizontal orientation (shown, in FIG. 8B) for forcing the hot oxygen gasses through the mold packs, depending upon size and space configurations for the heating chamber.

Figure 8C:
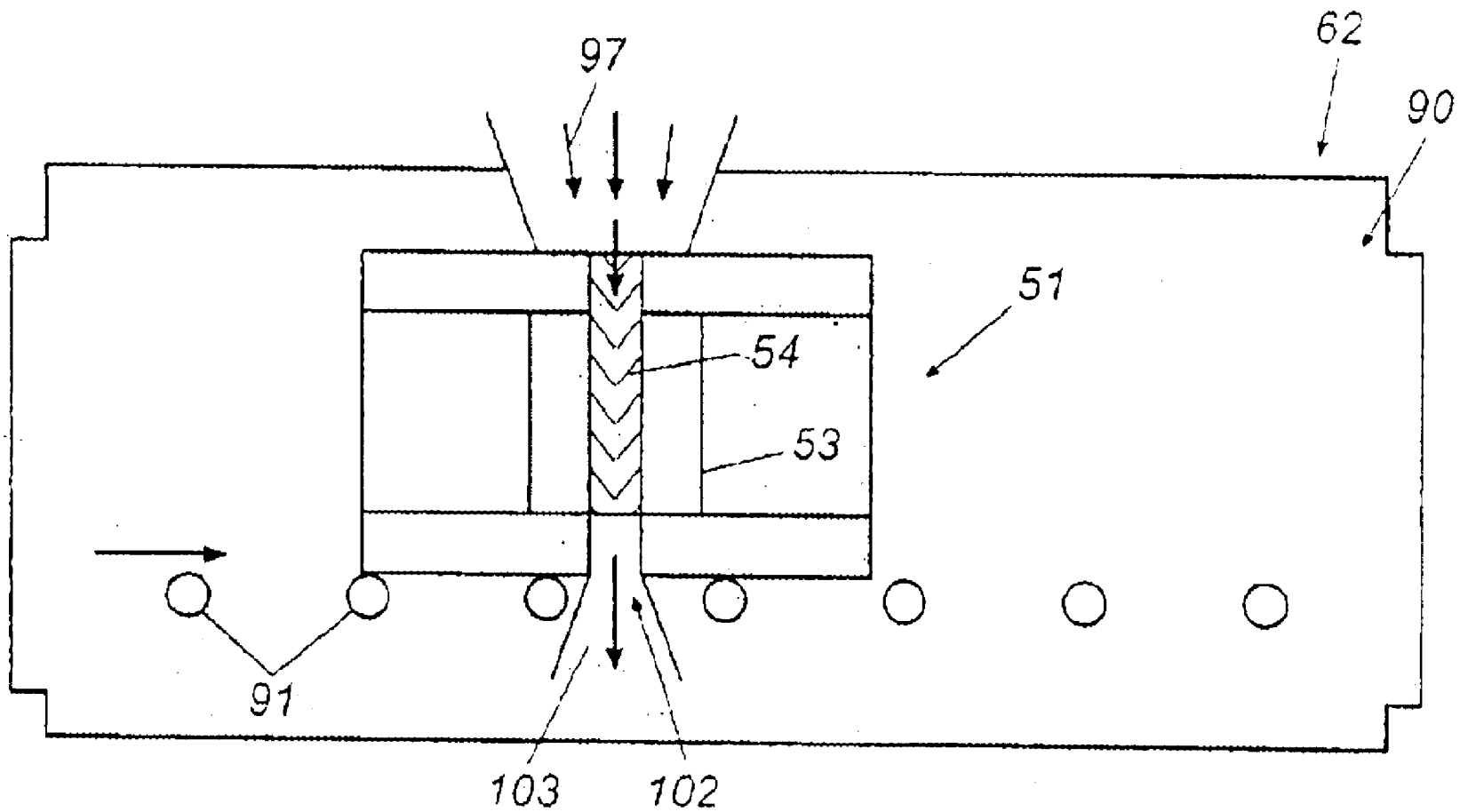

As indicated in FIG. 8C, the molds further can be formed with or to include a vacuum port or opening, indicated by 102, formed along either the upper or lower surfaces of the molds. A suction or vacuum, indicated at 103, is applied at the port 102 formed in each mold for drawing the oxygen gas into and through or molds. In this embodiment, the molds are gas or air tight and can include a plug (not shown) for sealing the port 102, but which can be removed from the port 102 to provide a suction or vacuum point along the molds as the oxygen gas is drawn or flows through the molds.

As the oxygen gas 97 is drawn through the molds by the suction 103, a percentage of oxygen is combusted with the binder material of the sand molds and/or sand cores, so as to enhance the combustion of the binder material within the heating chamber to provide a heat source for heating the castings. As a result, the molds and their castings are further supplied with heat energy from the enhanced combustion of the binder material thereof and the oxygen gas, which thus acts as a heat source to increase the temperature of the castings in the mold packs, while at the same type breaking down the binder of the molds and/or sand cores for ease of removal and reclamation.

Figure 9:
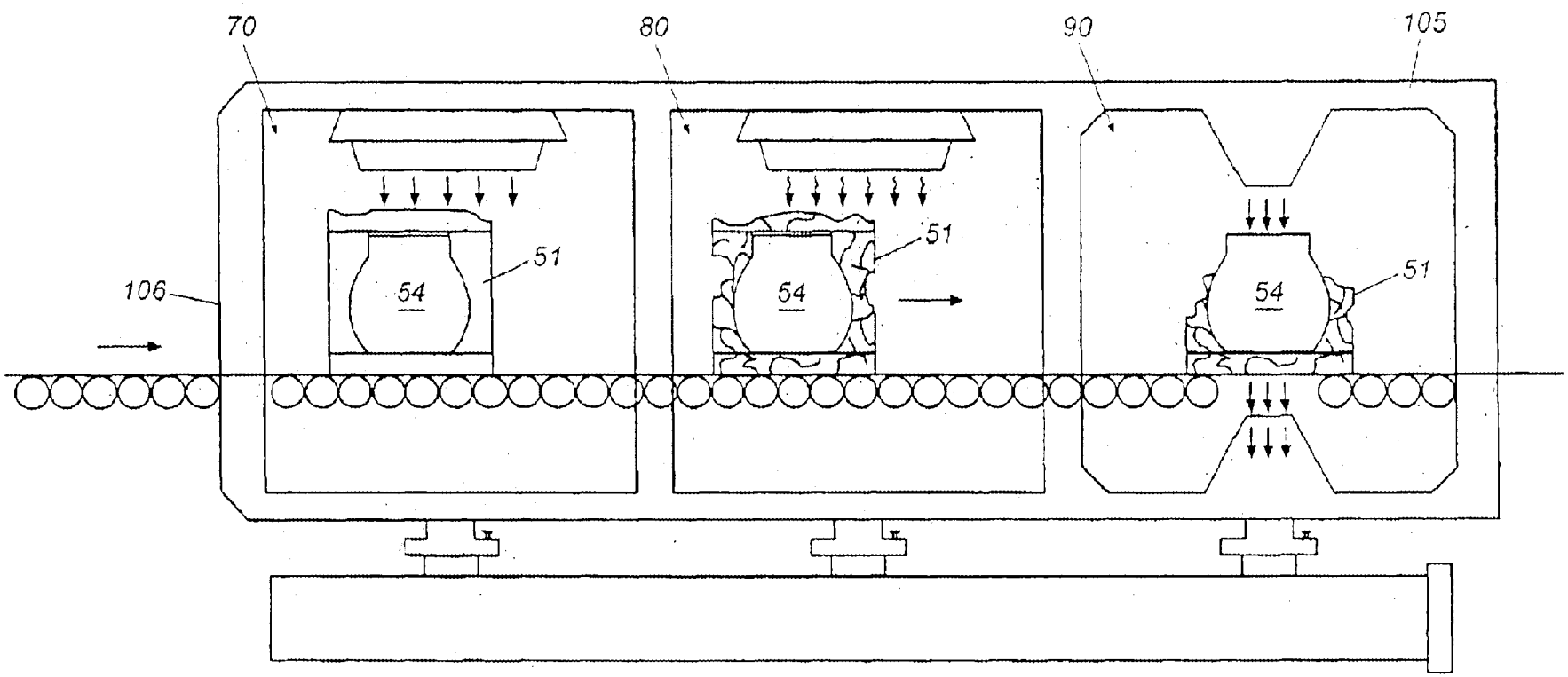
FIG. 9 illustrates an additional embodiment of a heat treatment unit including the various embodiments of heating chambers shown in FIGS. 6–8C, positioned in series.

It further will be understood that the various heat treatment chambers illustrated in FIGS. 6–8C can either be used separately, or can be mounted or positioned in a series along a heat treatment station or unit 105 (FIG. 9), defining separate stations or separate chambers thereof, for enhanced or increased breakdown and removal of the sand cores and sand molds from the castings. As shown in FIG. 9, a radiant energy heat treatment chamber 70 (FIG. 6) can be mounted or positioned at an upstream end 106 (FIG. 9) of the heat treatment unit 105. As the molds, with their castings therein are introduced into the heat treatment unit 105, they are received and initially passed through the heating chamber 70 and a radiant energy source therein. The radiant heating chamber 70 generally heats the molds to a temperature sufficient to initiate the combustion of the binder of the molds while the same time heating the castings therewithin to begin the heat treatment of the castings while still in-mold.

A further heating chamber 80, having an induction energy source therein, generally will be positioned downstream from the radiant heating chamber 70. The heating chamber 80 will apply induction energy via a high energy field of electromagnetic waves as discussed above, which generally will tend to further promote the combustion of the binder and heat treatment of the castings within the molds. In addition, the application of the inductive energy waves will tend to cause cracking or breaking of the sand molds into sections or pieces to further promote the breakdown of the sand molds.

Thereafter, an oxygen heating chamber 90, such as shown in FIGS. 8A–8C, will be positioned downstream from heating chamber 80. As the sand molds are passed into and through the heating chamber 90, the forced flow of oxygen through the chamber promotes and enhances the combustion of the sand molds and sand cores. As a result, with the binder of the sand molds having been raised to a combustion temperature and the molds becoming cracked in the heating chambers 70 and 80, and/or pieces thereof becoming broken or dislodged, the further enhancement of the combustion of the binder of the sand cores within the oxygen heating chamber 90 tends to promote the increased breakdown and dislodging of the sand molds and sand cores form the castings. Consequently, the time required for breakdown and removal of the sand molds and sand cores is decreased so that the castings are more rapidly exposed directly to the heating environment of the heat treating unit, while at the same time, the rapid breakdown and combustion of the binder of the sand molds further enhances the heating of the castings to their solution heat treatment temperatures.

As a result of applying energy to the molds themselves, the molds are heated to desired temperatures and can be maintained at a such temperatures as needed for heat treating the castings being formed therewithin as the molten metal of the casting is solidified within the molds. Such in-mold heat treatment of the castings can significantly cut the processing time required for heat treating castings, for example, to as low as approximately 10 minutes or less, as the metal of the castings is generally elevated and stabilized at the heat treatment temperature shortly after pouring of the molten metal material into the molds. Thus, the heat treatment of the castings can take place in a relatively short period of time following the pouring of the molten metal material into the molds. The raising of the temperature of the molds to the heat treatment temperature for heat treating the castings further enhances the breakdown and combustion of the combustible organic binders of the sand cores and/or sand molds, if used, so as to further reduce the time required for the heat treatment and dislodging and reclamation of the sand cores and sand molds of the casting process.

Following the heat treatment of the castings in their molds within the heat treatment station 62, the castings typically are removed from their molds and can be moved to an additional heat treatment station for completion of the heat treatment of the castings, as needed, and for sand core removal and possible reclamation of the sand materials of the cores. The castings are then moved into a quenching station 110 for quenching and cooling of the castings. Alternatively, as shown in FIG. 4, the castings can be removed from their dies and transferred directly to the quenching station. The quenching station 110 typically includes a quench tank having a cooling fluid such as water or other known coolant material, but the quenching station can also comprise a chamber having one or a series of nozzles, indicated at 111 in FIG. 4, that apply cooling fluids such as air or water to the castings. The quenching also can take place in contiguous ancillary quenching equipment that is in close proximity to the pouring station so that cycle time and heat variations can be minimized for the setting and treatment of the molten metal material of the castings within the molds.

After heat treatment and sand removal of the castings is completed, the castings can be removed from the molds and transferred to the quench tank of the quench station for cooling the castings before further processing, and sand removed from the castings then can be reclaimed for later reuse. In addition, as indicated in dashed lines in FIG. 4, it is also possible to transfer the casings directly from the pouring station to the quenching station. For example, where the molds from the pouring station are heated to a heat treatment temperature at or adjacent the pouring station for in-mold heat treating the castings, the treated castings thereafter can be transferred directly to the quenching station.

Figure 10A:
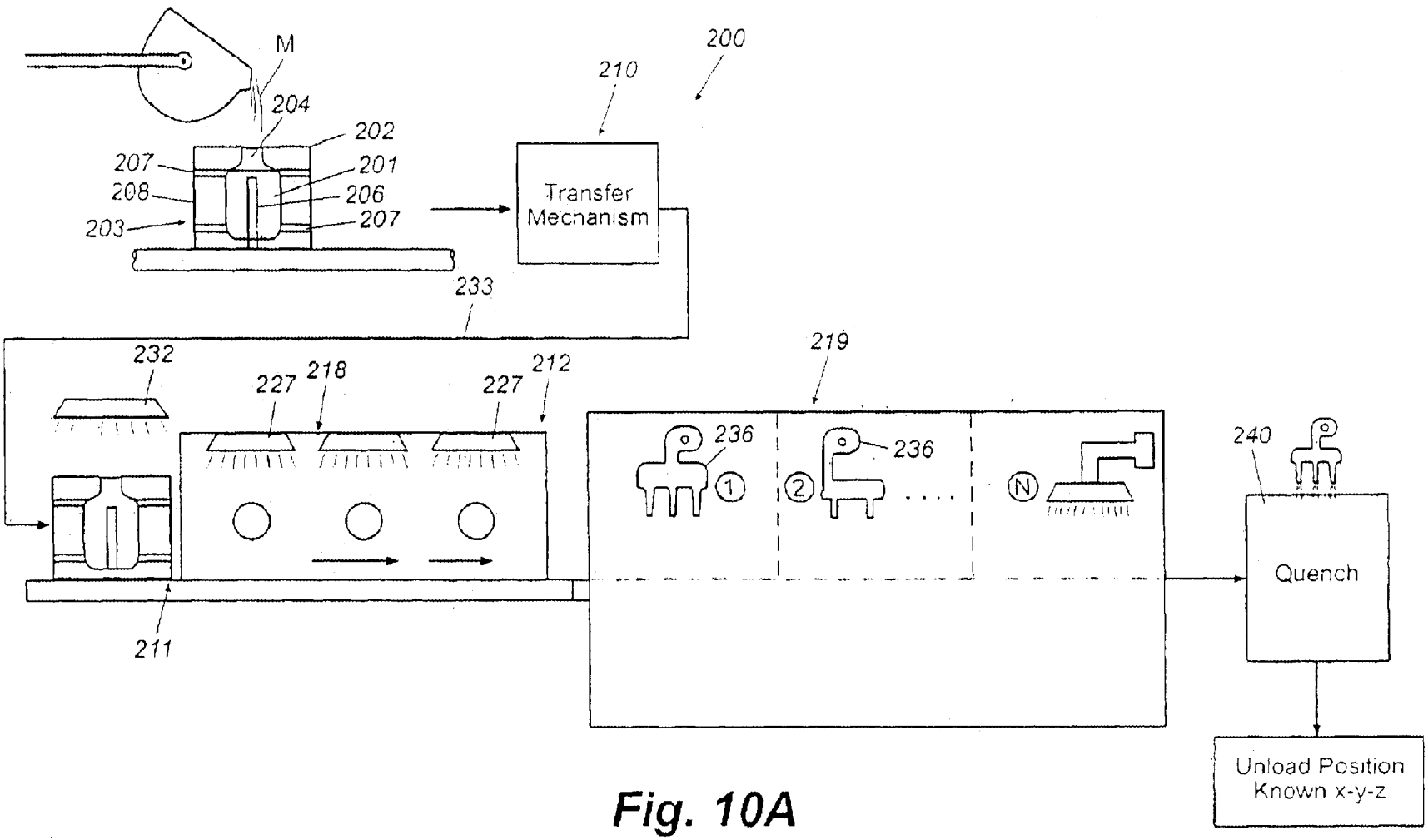
FIG. 10A is a schematic illustration of a further embodiment of the present invention for processing metal castings.
Figure 10B:
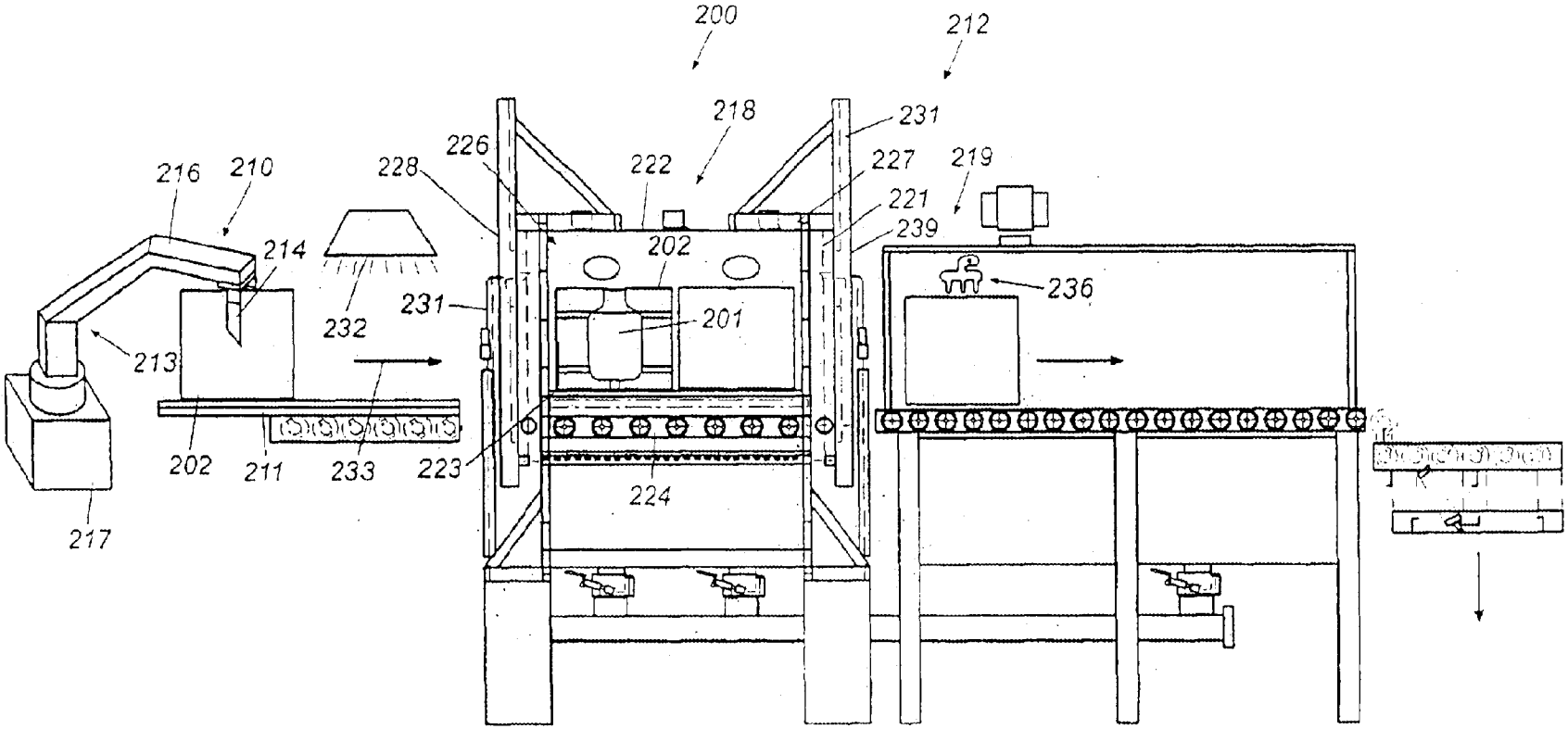
FIG. 10B is a side elevational view of the heat treatment line of the embodiment of the present invention of FIG. 10A.

FIGS. 10A and 10B illustrate still a further embodiment 200 of the present invention for the enhanced heat treatment and breakdown and removal of sand cores and/or sand molds from a series of castings 201. In this embodiment, a molten metal or metal alloy M (FIG. 10A) is poured into a mold, such as a cast iron or other permanent type die or a semi-permanent or precision sand mold 202 at a pouring or casting station 203. The molds generally include an internal cavity 204 in which the molten metal is received and solidified to form the casting 201 and in which a sand core 206 typically is provided for forming ports or other interior detail for the casting. Typically, the molds in this embodiment will also include a series of ports or mold access openings 207 that extend through the side walls 208 of the molds. These ports provide an access to the interior cavity or chamber 204, and thus the casting being formed therein, for direct application of heat to the castings while "in-mold" and for assistance in dislodging and removal of the sand cores 206 therefrom.

The castings thereafter are removed from the casting or pouring station 203 by a transfer mechanism 210, which transfers the molds with their castings therewithin or which first removes the castings and thereafter transfers the castings individually to an inlet conveyor or loading station, indicated by 211 in FIG. 10A, for a heat treatment line or unit 212. The transfer mechanism can include a crane or robotic arm 213, as illustrated in FIG. 10B, including a gripping or engaging portion 214 that is adapted to engage, grip and lift the molds and/or castings and is mounted to one end of a body or articulateable arm that is movably attached to a base portion 214. The crane or arm 213 thus is moveable between a transfer position at the pouring station and the inlet 211 of the heat treatment unit or line 212 as indicated in FIG. 10A. It will, however, be understood by those skilled in the art that various other systems or devices for transferring the castings from the pouring station to the heat treatment line also can be used, such as an overhead crane, winch, conveyor, hoist, carousel, push rods and other known material handling devices. The transfer mechanism 210 will position the molds or castings themselves at the inlet or loading station of the heat treatment line with the molds or castings being located in a known, indexed position with their X, Y and Z coordinates in a known orientation or alignment prior to heat treatment. In some embodiments, as discussed above, this can include locating or mounting the castings or molds on locator devices such as depositing one or more castings in a saddle having pins, walls and/or other types of locator devices therein so as to locate and fix the position of the molds or castings within the saddles.

Thereafter with the molds and/or castings located in their known, desired positions, the molds and/or castings will be introduced into a process temperature control station or pre-treatment chamber 218 prior to introduction into the heat treatment furnace 219 of the heat treatment unit 212. Generally, during the transition or transfer of the castings from the pouring station to the heat treatment line, the castings will be permitted to cool a sufficient amount as is necessary for the molten metal within the molds to solidify and harden to form the castings. However, as the metal of the castings is cooled below the point at which it has solidified, it reaches a process control temperature below which the time required to both raise the temperature of the metal of the castings back up to a solution heat treatment temperature and for performing the heat treatment thereof is significantly increased. This process control temperature generally varies depending upon the metal and/or metal alloy being used to form the casting generally ranging from temperatures of approximately 400° C. or lower for some metals or alloys such as aluminum/copper alloys, up to approximately 1000° C.–1300° C. or greater for other metals or alloys such as iron and steel. For example, for aluminum/copper alloys, the process control temperature can generally range from about 400° C. to about 470° C., which temperatures generally fall below the solution heat treatment temperatures for most aluminum/copper alloys, which instead range from approximately 475° C. to approximately 490° C. and occasionally higher.

It has been discovered that when the metal of a casting is permitted to cool below its process control temperature, it generally is necessary thereafter to heat the casting for an additional time, such as approximately an additional 4 minutes or more for each minute that the metal of the casting is allowed to cool below its process control temperature in order to raise and maintain the temperature of the metal of the castings back up to the desired solution heat treatment temperature so that heat treatment of the castings can be performed. As a result, if a casting is permitted to cool below the process control temperature for the metal thereof for even a short time, the time required to process and completely heat treat the castings generally will be significantly increased. For example, if a casting is permitted to cool below its process control temperature for approximately 10 minutes, it can take as much as 40 minutes or more of additional heat treatment/soaking time at the solution heat treatment temperature for the metal of the castings in order to properly and completely heat treat the casting. In addition, in a batch processing system wherein the castings are one of several that are loaded into a basket or tray for processing numerous castings in a batch at a single time, it generally has been necessary to heat treat the entire batch of castings for a time and to an extent necessary to completely heat treat the casting(s) with the lowest temperature. This accordingly will require that the majority of the castings in the batch will be subjected to heat treatment for a significantly longer period of time than required to ensure complete treatment of all castings in the batch, thus resulting in wasted energy and increased processing times for the castings.

As indicated in FIGS. 10A and 10B, the process temperature control station 218 generally is an elongated tunnel or unit having side walls 221, a ceiling 222 and a floor or bottom 223 through which a conveyor or similar transport mechanism 224 is extended for conveying the molds and/or castings therethrough. The ceiling 222 and sides 221 of the process temperature control station 218 generally are formed from or have applied thereto a radiant material such as a metal, metal foil, ceramic or other types of composite materials that radiate or direct heat inwardly toward the castings so as to thus define a radiant chamber 226 within the process temperature control station.

A series of heat sources 227 generally are mounted in the ceiling and/or along the side walls of the process temperature control station so as to direct a flow of heat energy into the chamber 226 to create a heated environment therewithin. The heat sources 227 can include radiant heaters such as infrared or inductive heating elements, conductive, convection, or other types of heating elements, including the use of nozzles that spray a heated fluid media, such as air, water, steam, thermal oils and the like, about the molds and/or castings. The process temperature control station 218 further generally includes an inlet or upstream end 228 and a downstream or outlet end 229, each of which can include a sliding door, curtain or similar closure device 231.

As the molds and/or castings are received through the inlet end 228 of the process temperature control station, the cooling of the castings is arrested by the application of heat from heat sources 227. Thereafter, the castings are generally maintained at or above their process control temperature, which temperature generally varies depending upon the metal used to form the castings until the castings are introduced into the heat treatment furnace 219. As a result, the castings are permitted to cool sufficiently to allow the metal thereof to solidify, while the cooling of the castings is arrested at or above the process control temperature. As a result, the castings are introduced into the heat treatment furnace, they can be more efficiently and rapidly brought to their solution heat treatment temperatures and subjected to substantially complete heat treatment more efficiently.

In addition, as indicated in FIG. 10B, an additional heat source or heating element 232 can be mounted above the inlet 211 for the heat treatment line 219 so as to apply heat to the castings as they are deposited onto the heat treatment line and are introduced into the process temperature control station. It is also possible to mount a heat source such as a radiant heater, convection, conduction or other heating element on the transfer mechanism itself, or along the path of travel 233 (FIG. 10A) of the castings so as to apply heat to the castings during the transfer of the castings from the pouring station to the heat treatment line.

Typically, as illustrated in FIGS. 10A and 10B, the castings and/or molds with the castings therein will be passed from the process temperature control station directly into the heat treatment furnace 219 of the heat treatment line. The heat treatment furnace generally will comprise a heat treatment furnace or station as discussed above with respect to the embodiments of FIGS. 1 and 4. An example of such a heat treatment furnace for heat treatment and at least partial breakdown and/or reclamation of the sand cores and/or sand molds from the castings is illustrated in U.S. Pat. Nos. 5,294,994; 5,565,046; 5,738,162, and 6,217,317, the disclosures of which have previously been incorporated by reference.

As discussed above, the heat treatment furnace generally includes a series of treatment zones, chambers or stations, indicated by 236 in FIG. 104, for applying heat to the molds and/or castings for heat treatment of the castings. As the castings are moved through these heat treatment zones in their molds, the castings can be heat treated while at least partially "in-mold", while at the same time the sand molds in which the castings are contained can be rapidly broken down and removed from the castings and the sand materials thereof reclaimed. The heat treatment zones or chambers also can include a variety of different heating environments such as conductive or convection heating chambers, radiant heating chambers or chambers in which an enhanced or negative air pressure draws a flow of oxygen through the sand molds of the castings to enhance the combustion of the binders of the sand molds. The heat treatment furnace further can be divided into as many or as few treatment zones as an individual application may require depending upon the castings being processed.

After passing through the heat treatment furnace 219, the castings thereafter generally are removed from the heat treatment furnace and can be transported to a quench station 240 (FIG. 10A) for quenching or further processing.

Accordingly, the present invention enables the reduction or elimination of a requirement for further heat treating of the castings once removed from the molds, which are heated to provide solution heating time and cooled to provide the quenching effect necessary, while in-mold, so as to significantly reduce the amount of heat treatment/processing time required for forming metal castings. The present invention further enables an enhanced or more efficient heat treatment and breakdown and removal of sand cores within the castings by directing fluid flows at the castings at preset positions, corresponding to known orientations or alignments of the castings and/or the molds with the castings contained therein as they are passed through a heat treatment station.

It will be understood by those skilled in the art that while the present invention has been discussed above with reference to preferred embodiments, various additions, modifications and changes can be made thereto without departing from the spirit and scope of the invention as set forth in the following claims.

What is claimed is:

1. A system for processing castings comprising:

a series of molds each containing a core and in which a molten metal is received to define and form a casting;

a series of saddles adapted to receive the castings in a desired orientation having known, indexed position coordinates; and a heat treatment station in which the saddles, with the castings located in their known, indexed positions therein, are received for heat treatment of the castings and core removal, said heat treatment station including:

at least one heating zone through which the castings are moved with the castings oriented in predefined, known positions, and wherein a fluid media is applied to the castings to heat treat the castings and degrade said cores within the castings.

2. The system of claim 1 and wherein said heat treatment station includes a plurality of nozzle stations each comprising a series of robotically operated nozzles adapted to move about the castings between at least first and second nozzle positions in alignment with a series of core openings formed in the castings for directing the fluid media toward the castings from different directions to degrade the cores.

3. The system of claim 1 and wherein said saddles each include a series of walls defining a casting receptacle and a plurality of locating devices positioned within said casting receptacle, so as to engage and guide the castings into their known, indexed positions having known position coordinates within said saddles.

4. The system of claim 3 and wherein said locating devices comprise guide pins and wherein the castings are formed in said molds with corresponding locating openings in which said guide pins are received for locating the castings in their known, indexed positions within said saddles.

5. The system of claim 1 and wherein said molds include an internal heating source for preheating said molds and at least partially heat treating the castings.

6. The system of claim 5 wherein said internal heating source comprises a heated fluid media received and/or circulated through said molds for heating said molds internally to a soak temperature for at least partially heat treating the castings therewithin.

7. The system of claim 1 and further comprising a radiant chamber positioned upstream from said heat treatment station and having at least one heat source, wherein heat is applied to the castings as they are received and move through said radiant chamber sufficient to arrest cooling of the castings to at least a process control temperature prior to the castings being moved into said heat treatment station.

8. The system of claim 7 and further comprising a source of fluid media within the radiant chamber for directing the fluid media into the casting to degrade the core therein.

9. The system of claim 1, wherein said cores are formed of material that is soluble in said fluid media applied to the castings.

10. The system of claim 9, wherein said fluid media is selected from water, steam, organic solvents, thermal oils and combinations thereof.

* * * * *